US008938175B2

(12) United States Patent
Kanehara et al.

(10) Patent No.: US 8,938,175 B2
(45) Date of Patent: Jan. 20, 2015

(54) IMAGE FORMING DEVICE HAVING A SHARED VOLTAGE SUPPLY AND CONSTANT CURRENT CONTROL

(71) Applicant: Brother Kogyo Kabushiki Kaisha, Nagoya (JP)

(72) Inventors: Kohei Kanehara, Nagoya (JP); Tsuyoshi Maruyama, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 91 days.

(21) Appl. No.: 13/627,463

(22) Filed: Sep. 26, 2012

(65) Prior Publication Data

US 2013/0108295 A1 May 2, 2013

(30) Foreign Application Priority Data

Oct. 28, 2011 (JP) ..... 2011-237208

(51) Int. Cl.
*G03G 15/02* (2006.01)

(52) U.S. Cl.
CPC ..... *G03G 15/0266* (2013.01); *G03G 15/0291* (2013.01)
USPC ..... 399/50; 399/171

(58) Field of Classification Search
USPC ..... 399/50, 171
See application file for complete search history.

(56) References Cited

U.S. PATENT DOCUMENTS

2006/0024074 A1 2/2006 Maeda et al.
2010/0080593 A1 4/2010 Inukai et al.
2010/0278547 A1* 11/2010 Maruyama et al. ..... 399/31
2012/0027436 A1 2/2012 Maruyama et al.
2012/0027437 A1* 2/2012 Maruyama et al. ..... 399/31
2012/0051762 A1* 3/2012 Maruyama et al. ..... 399/31
2012/0051772 A1* 3/2012 Inukai ..... 399/50
2012/0082470 A1* 4/2012 Inukai et al. ..... 399/31

FOREIGN PATENT DOCUMENTS

JP H03-142483 A 6/1991
JP 2006-047490 A 2/2006
JP 2010-102289 A 5/2010
JP 2012-032531 A 2/2012

OTHER PUBLICATIONS

U.S. Appl. No. 14/336,013, filed Jul. 21, 2014, entitled Image Forming Apparatus.

* cited by examiner

*Primary Examiner* — G. M. Hyder
(74) *Attorney, Agent, or Firm* — Merchant & Gould PC

(57) ABSTRACT

An image forming device, comprising: at least one photosensitive body; scorotron chargers that charge the at least one photosensitive body; a charge voltage applying circuit to which the scorotron chargers are commonly connected, the charge voltage applying circuit being configured to apply a voltage to the scorotron chargers; wires respectively provided for the scorotron chargers; grid electrodes respectively provided for the scorotron chargers; a current detection unit configured to detect a grid current of each of the grid electrodes; and a grid current control unit configured to execute a constant-current control for a maximum grid current which is a maximum of grid currents flowing through the grid electrodes so that the maximum grid current is kept at a first threshold larger than or equal to a reference value by adjusting an output of the charge voltage applying circuit.

7 Claims, 12 Drawing Sheets

IMAGE FORMING DEVICE HAVING A SHARED VOLTAGE SUPPLY AND CONSTANT CURRENT CONTROL

CROSS-REFERENCE TO RELATED APPLICATION

This application claims priority under 35 U.S.C. §119 from Japanese Patent Application No. 2011-237208, filed on Oct. 28, 2011. The entire subject matter of the application is incorporated herein by reference.

BACKGROUND

1. Technical Field

Aspects of the present invention relate to an image forming device.

2. Related Art

Multi-color image forming devices (e.g., a color laser printer) having a plurality of chargers, the number of which is equal to the number of colors of developer, have been used. Among the image forming devices of this type, an image forming device, in which a high-voltage unit (a high voltage circuit) for applying a high voltage is shared by the plurality of chargers so as to reduce the number of parts and to make the image forming device compact in size, has been used.

SUMMARY

However, if the high voltage unit is shared, it becomes impossible to individually adjust voltage levels to be applied to the respective chargers. On the other hand, wires provided in the chargers do not necessarily get dirty uniformly. Therefore, if the high voltage unit is shared, the discharge amounts may vary between the chargers and thereby an abnormal discharge may occur.

Aspects of the present invention are advantageous in that they provide an image forming device in which a voltage supply unit is shared and which is capable of suppressing occurrence of abnormal discharge.

According to an aspect of the invention, there is provided an image forming device, comprising: at least one photosensitive body; a plurality of scorotron chargers that charge the at least one photosensitive body; a charge voltage applying circuit to which the plurality of scorotron chargers are commonly connected, the charge voltage applying circuit being configured to apply a voltage to the plurality of scorotron chargers; wires respectively provided for the plurality of scorotron chargers; grid electrodes respectively provided for the plurality of scorotron chargers; a current detection unit configured to detect a grid current of each of the grid electrodes; and a grid current control unit configured to execute a constant-current control for a maximum grid current which is a maximum of grid currents flowing through the grid electrodes so that the maximum grid current is kept at a first threshold larger than or equal to a reference value by adjusting an output of the charge voltage applying circuit.

BRIEF DESCRIPTION OF THE ACCOMPANYING DRAWINGS

DETAILED DESCRIPTION

First Embodiment

Hereafter, a first embodiment will be described with reference to FIGS. 1 to 9.

<1. Overall Configuration of Printer>

In the following explanation, when units are explained separately in regard to respective colors, suffixes B (Black), Y (yellow), M (magenta) and C (cyan) are added to the respective units, and when units are explained without differentiating the units in regard to the colors, these suffixes are not used.

Figure 1:
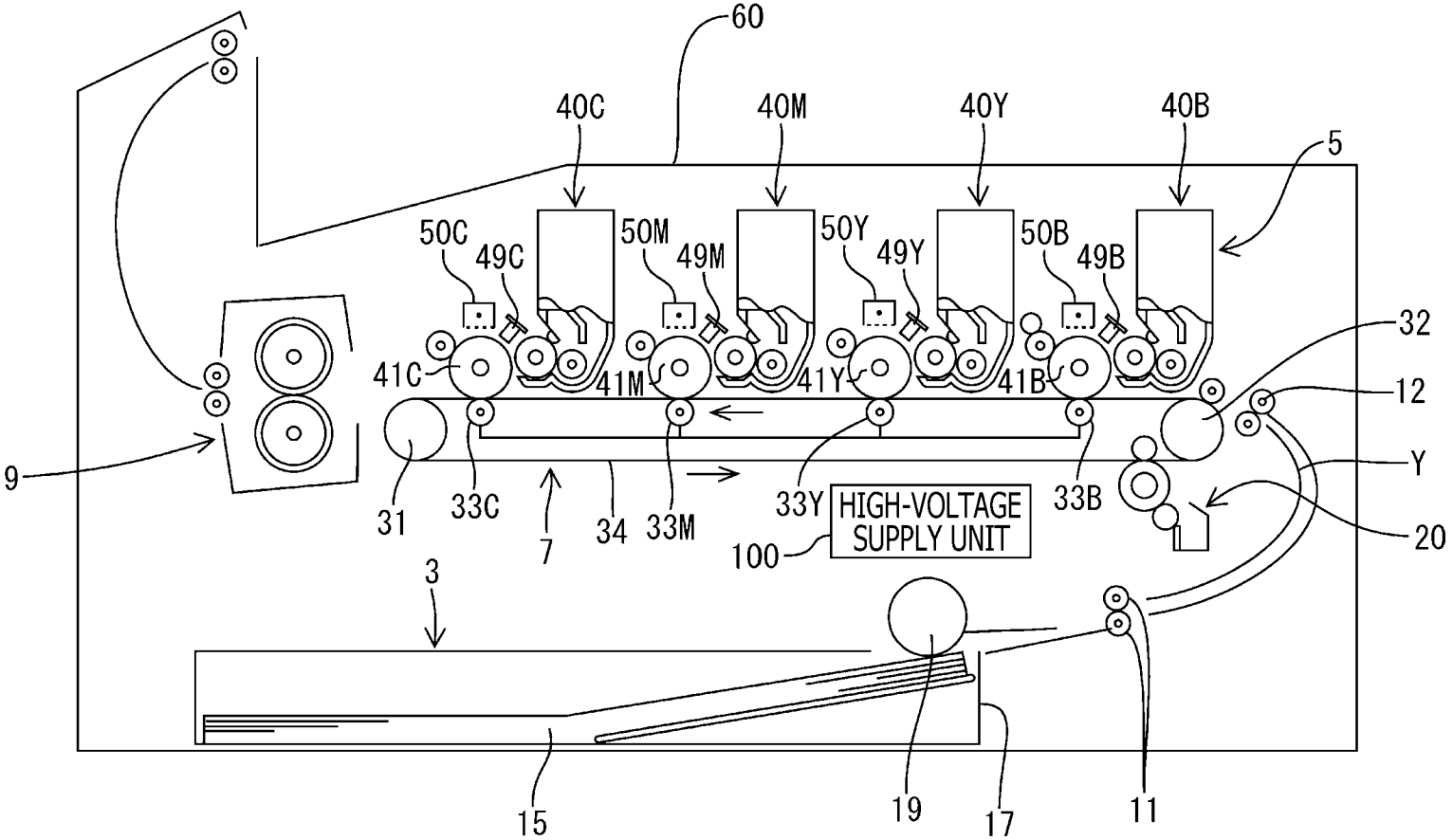
FIG. 1 is a side cross section of a printer according to a first embodiment, generally illustrating an internal configuration of the printer according to a first embodiment.

As shown in FIG. 1, a printer 1 includes a paper supply unit 3, an image formation unit 5, a earning mechanism 7, a fixing unit 9, a belt cleaning unit 20 and a high-voltage supply unit 100. The paper supply unit 3 is located at the bottom of the printer 1, and includes a tray 17 for accommodating sheet-like recording medium (e.g., sheets of paper or OHP sheets) 15 and a pick-up roller 19. The sheet-like medium accommodated in the tray 17 is picked up one by one by the pick-up roller 19, and is sent to the earning mechanism 7 via a carrying roller 11 and a registration roller 12.

The carrying mechanism 7 carries the sheet-like medium 15, and is provided above the paper supply unit 3 in the printer 1. Specifically, the carrying mechanism 7 includes a drive roller 31, a driven roller 32 and a belt 34. The belt 34 is provided to extend between the drive roller 31 and the driven roller 32. When the drive roller 31 rotates, the belt 34 moves such that a surface of the belt 34 facing photosensitive drums 41B, 41Y, 41M and 41C moves from the right side to the left side in FIG. 1. As a result, the sheet-like medium 15 sent from the registration roller 12 is carried to a position under the image formation unit 5.

For the belt 34, four transfer rollers 33B, 33Y, 33M and 33C are provided respectively for the four photosensitive drums 41B, 41Y, 41M and 41C. The transfer rollers 33 are respectively located at positions facing the photosensitive drums 41B, 41Y, 41M and 41C while sandwiching the belt 34 between the transfer rollers 33 and the photosensitive drums 41.

The image formation unit 5 includes four process units 40B, 40Y, 40M and 40C and four exposure units 49B, 49Y, 49M and 49C. The process units 40B, 40Y, 40M and 40C are arranged in line along a carrying direction (a left and right direction in FIG. 1) for the sheet-like medium 15.

The process units 40 have the same configuration. Each process unit 40 includes a photosensitive drum (41B, 41Y, 41M or 41C), a toner casing 43 for accommodating toner (e.g., non-magnetic single-component toner with a positive charging property) of a corresponding color, a development roller 45 (an example of a developing unit) and a charger (50B, 50Y, 50M or 50C).

For example, each of the photosensitive drums 41B, 41Y, 41M and 41C is formed such that a photosensitive layer with a positive charging property is formed on a base material made f aluminum and the base material is grounded to the ground of the printer.

The development roller 45 is located to face a supply roller 46 in a lower portion of the toner casing 43. The development roller 45 serves to cause the toner to be charged positively by friction with the supply roller 46 when the toner passes between the development roller 45 and the supply roller 46, and to supply the toner to form uniform thin layers on the corresponding one of the photosensitive drums 41B, 41Y, 41M and 41C.

Figure 2:
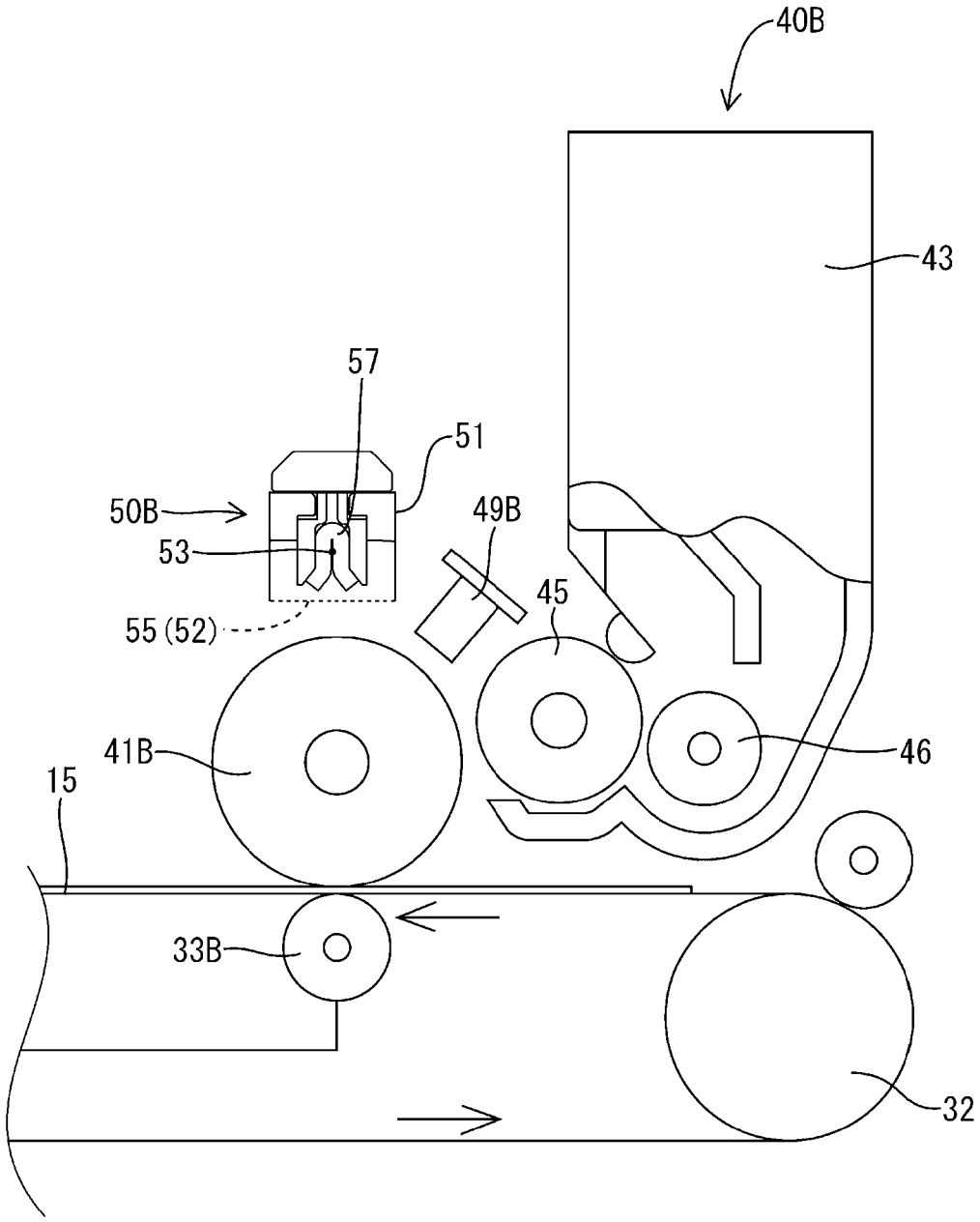
FIG. 2 illustrates a configuration of a process unit.
Figure 3:
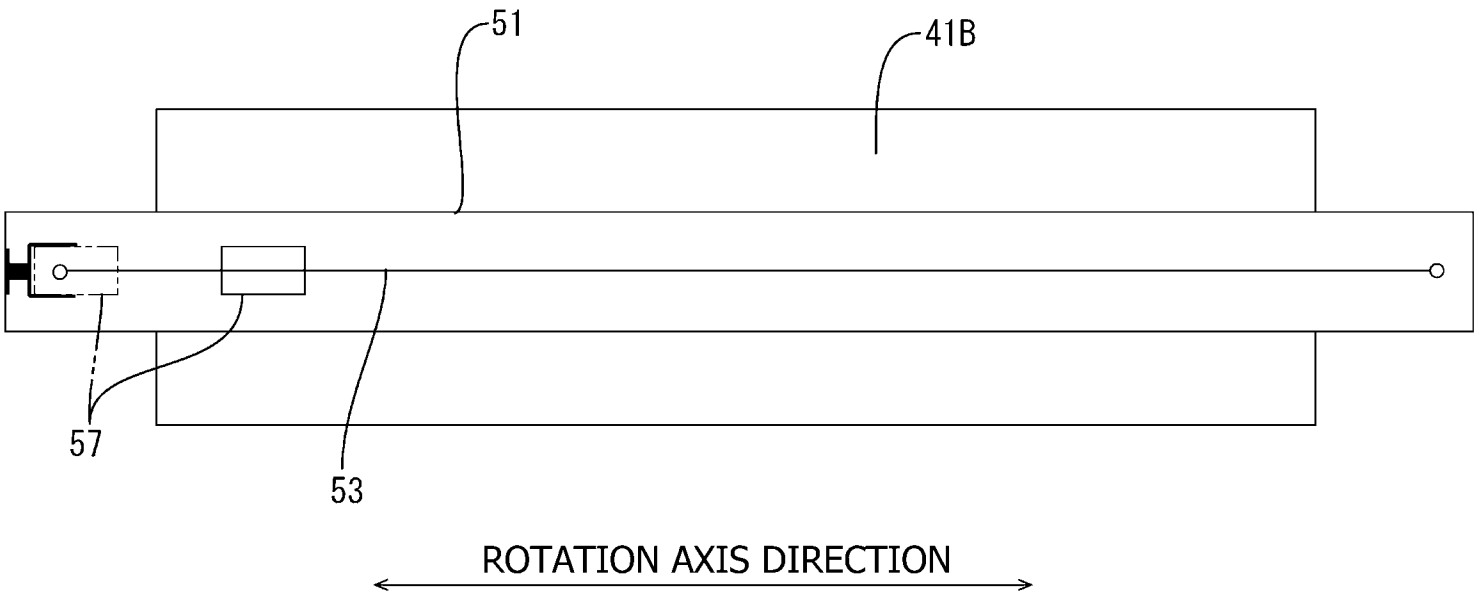
FIG. 3 illustrates a configuration of a charger.

Each of the chargers 50 is a scorotron charger, and, as shown in FIGS. 2 and 3, each charger 50 includes a shield casing 51, a wire 53 and a metal grid electrode 55. The shield casing 51 has a shape of a square tube elongated in the rotation axis direction of the photosensitive dram 41. A face of the shield casing 51 facing the photosensitive drum 41 is formed as an opening (a discharge opening 52).

The wire 53 is formed of, for example, a tungsten wire. The wire 53 is provided to extend in the rotation axis direction (the left and right direction in FIG. 3) in the shield casing 51. To the wire 53, a high voltage is applied from a charge voltage application circuit 200 which is described later. When a high voltage is applied to the wire 53, the wire 53 causes corona discharge in the shield casing 51. Since ions caused by the corona discharge flow, as a discharge current, from the discharge opening 52 to the photosensitive drum 41 side, the surface of the photosensitive drum 41 is positively charged uniformly.

A plate-like electrode 55 having slits is attached to the discharge opening 52 of the shield casing 51. By applying a voltage to the grid electrode 55 and controlling the applied voltage, it becomes possible to control the charge voltage of the photosensitive drum 41.

In each of the chargers 50B, 50Y, 50M and 50C, a wire cleaner 57 is provided. The wire cleaner 57 is configured to be able to slide along the wire 53. By letting an operator move the wire cleaner 57 to reciprocate along the wire 53, dust adhered to the wire 53 can be removed.

Each of the exposure units 49B, 49Y, 49M and 49C includes, for example, a plurality of light emitting devices (e.g., LEDs and laser sources) arranged in line along the rotation axis direction. By causing the plurality of light emitting devices to emit light in accordance with image data inputted, externally, each exposure unit serves to form an electrostatic latent image on the surface of the photosensitive drum (41B, 41Y, 41M or 41C).

A sequence of image formation process executed, by the laser printer 1 configured as described above is briefly explained below. When the printer 1 receives print data D (see FIG. 6), the printer 1 starts a print process. As a result, the surfaces of the photosensitive drums 41B, 41Y, 41M and 41C are positively charged uniformly by the respective chargers 50B, 50Y, 50M and 50C in accordance with rotations thereof. Then, the exposure units 49 emit laser light to the respective photosensitive drums 41B, 41Y, 41M and 41C. As a result, electrostatic latent images corresponding to the print data are formed on the surfaces of the respective photosensitive drums 41B, 41Y, 41M and 41C. That is, on the surfaces of the photosensitive drams 41B, 41Y, 41M and 41C charged positively and uniformly, potentials of parts of the surfaces irradiated with the laser light decrease.

Then, with rotations of the development roller 45, the toner which is held on the development roller 45 in a state of being positively charged is supplied to the electrostatic latent image formed on the surface of each of the photosensitive drums 41B, 41Y, 41M and 41C. As a result, the electrostatic latent images on the photosensitive drums 41B, 41Y, 41M and 41C are visualized, and toner images by reversal development are formed on the surfaces of the photosensitive drums 41BB, 41Y, 41M and 41C.

Concurrently with the above described process for forming the toner image, a process for carrying the sheet-like medium is executed. That is, by rotations of the puck-up roller 19, the sheet-like medium 15 is sent one by one to a paper carrying path Y. The sheet-like medium 15 sent to the paper carrying path Y is carried to a transfer position (a point at which the photosensitive drum 41 contacts the transfer roller 33) by the carrying roller 11 and the belt 34.

When the sheet-like medium passes by the transfer position, the toner images of the respective colors held on the photosensitive drums 41 are transferred sequentially to the surface of the sheet-like medium 15 to overlap with respect to each other. Consequently, a color toner image (a developer image) is formed on the sheet-like medium 15. Thereafter, the transferred toner image (the developer image) is heat-fixed when the sheet-like medium 15 passes through the fixing unit 9 provided on the rear side of the belt 34, and then the sheet-like medium 15 is ejected to an output tray 60.

<2. Configuration of High-Voltage Supply Unit 100>

Figure 4:
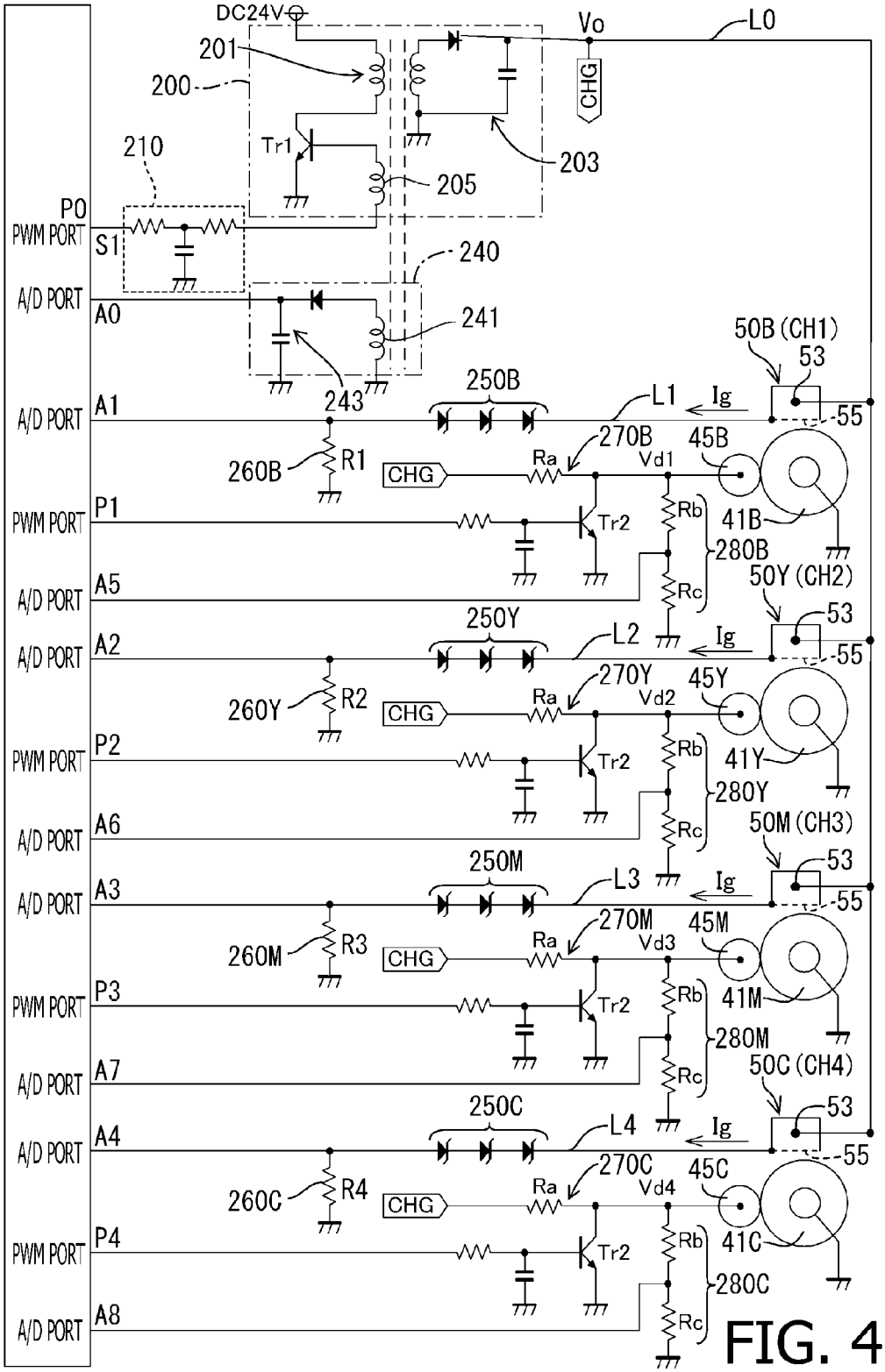
FIG. 4 is a block diagram of an electric configuration of a high-voltage supply unit.

As shown in FIG. 4, the high-voltage supply unit 100 includes a charge voltage applying circuit 200, a PWM signal smoothing circuit 210, a charge voltage detection circuit 240, constant-voltage circuits 250B, 250Y, 250M and 250C, grid, current detection units 260B, 260Ym 260M and 260C, development voltage applying circuits 270B, 270Y, 270M and 270C, development voltage detection circuits 280B, 280Y, 280M and 280C, and a control unit 110.

The PWM signal smoothing circuit 210 is an integrating circuit formed of resistances and a capacitor. The PWM signal smoothing circuit 210 smoothes a PWM signal S0 outputted from a PWM port P0 of the control unit 110, and outputs the smoothed signal to a base of a transistor Tr1 provided in the charge voltage applying circuit 200.

The charge voltage applying circuit 200 generates a high voltage of around 6 kV to 8 kV from an input voltage of 24V, and applies the high voltage to each charger 50. In this embodiment, a self-oscillation type flyback converter (RCC) is used as the charge voltage applying circuit 200. The charge voltage applying circuit 200 includes a transformer 201, a smoothing circuit 203 provided on the secondary side of the transformer 201, the transistor Tr1 provided on the primary side of the transformer 201 and a feedback coil 205.

The transistor Tr1 serves as a switching device for the transformer 201. An emitter of the transistor Tr1 is connected to the ground, and a collector of the transistor Tr1 is connected to the primary side winding. To the base of the transistor Tr1, the PWM signal smoothing circuit 210 is connected via the feedback coil 205.

To an output line Lo of the charge voltage applying circuit 200, the wires 53 of the chargers 50B, 50Y, 50M and 50C are connected in common. With this configuration, the output voltage Vo of the charge voltage applying circuit 200 is applied to the wire 53 of each of the chargers 50B, 50Y, 50M and 50C.

The charge voltage detection circuit 240 detects the output voltage Vo of the charge voltage applying circuit 200. The charge voltage detection circuit 240 includes an auxiliary winding 241 provided on the primary side of the transformer 201, and an integrating circuit 243 having a resistance and a capacitor. The charge voltage detection circuit 240 is connected to an AD port A0 of the control unit 11, so that data concerning the output voltage Vo of the charge voltage applying circuit 200 is inputted to the control unit 110.

As shown in FIG. 4, in this embodiment, connection lines L1 to L4 are respectively provided for the chargers 50B, 50Y, 50M and 50C, and the grid electrodes 55 of the chargers 50B, 50Y, 50M and 50C are connected to the ground via the respective connection lines L1 to L4. On each of the connection lines L1 to L4. On each of the connections lines L1 to L4, the constant-voltage circuit 250 and the grid current detection unit 260 are provided.

Each of the constant-voltage circuits 250B, 250Y, 250M and 250C is formed of three zener diodes, and makes the voltage value of the grid electrode 55 of each of the chargers 50B, 50Y, 50M and 50C constant by setting the voltage value of the grid electrode 55 of each of the chargers 50B, 50Y, 50M and 50C to the three-fold value (e.g., 250V×3) of the breakdown voltage of each zener diode.

The grid current detection units 260B, 260Ym 260M and 260C respectively include the resistances R1 to R4 which are respectively connected in series to the constant-voltage circuits 250B, 250Y, 250M and 250C. Connection points of the resistances R1 to R4 with respect to the constant-voltage circuits 250B, 250Y, 250M and 250C are respectively connected to the AD ports A1 to A4 of the control unit 110 via signal lines. As a result, voltages proportional to the currents flowing through the connection lines L1 to L4 are inputted to the AD ports A1 to A4, respectively. With this configuration, by reading the input voltage levels of the AD ports A1 to A4, it becomes possible for the control unit 110 to detect the magnitudes of the grid currents Ig of the chargers 50B, 50Y, 50M and 50C.

The development voltage applying circuits 270B, 270Y, 270M and 270C serve to apply development voltages Vd1 to Vd4 to the development rollers 45B, 45Y, 45M and 45C, respectively. The development voltage applying circuits 270B, 270Y, 270M and 270C are individually provided for the development rollers 45B, 45Y, 45M and 45C.

The development voltage applying circuits 270B, 270Y, 270M and 270C are connected in common to the output line Vo of the charge voltage applying circuit 200. In the following, the development voltage applying circuit 270B is explained as a representative. The development voltage applying circuit 270B includes a resistance Ra and a control transistor Tr2. An end of the resistance Ra is connected to the output line Lo of the charge voltage applying circuit 200.

The control transistor Tr2 is an NPN transistor. A base of the control transistor Tr2 is connected to the PWM port P1 of the control unit 110 via a signal line. On the signal line, an integrating circuit formed of a capacitor C and a resistance R is provided. With this configuration, the PWM signal outputted from the PWM port P1 of the control unit 110 is smoothed and is applied to the base of the control transistor Tr2.

With the above described, configuration, by adjusting the voltage to be applied to the base of the control transistor Tr2 by using the PWM signal, it becomes possible to control the development voltage applied to the development roller 45. It should be noted that the applied development voltage is a voltage obtained by subtracting the voltage drop by the resistance Ra from the output voltage Vo of the charge voltage applying circuit 200.

As in the case of the development voltage applying circuit 270B, each of the development voltage applying circuits 270Y, 270M and 270C is formed of the resistance Ra and the control transistor Tr2. By adjusting the voltage to be applied to the base of the control transistor Tr2 by using the PWM signal, the development voltage applying circuits 270Y, 270M and 270C are able to control the respective development voltages applied to the development rollers 45Y, 45M and 45C.

As shown in FIG. 4, in the development voltage applying circuits 270B, 270Y, 270M and 270C, the development voltage detection circuits 280B, 280Y, 280M and 280C which detect the output voltages Vd1 to Vd4 (development voltages) are provided, respectively. Each of the development voltage detection circuits 280B, 280Y, 280M and 280C is formed of resistances Rb and Rc connected in series. The development voltage detection circuits 280B, 280Y, 280M and 280C are respectively connected in parallel with the control transistors Tr of the development voltage applying circuits 270B, 270Y, 270M and 270C.

At respective intermediate connection points of the resistances Rb and Rc, voltages defined by dividing the output voltages Vd1 to Vd4 of the development voltage applying circuit 270 by the resistance ratio appear respectively. The AD ports A5 to A8 of the control unit 110 are connected, via the signal lines, to the respective intermediate points of the resistances Rb and Rc forming the development voltage detection circuits 280B to 280C.

Therefore, the output voltages Vd1 to Vd4 of the development voltage applying circuits 270B to 270C can be detected from the voltage levels of the AD ports A5 to A8.

The control unit 110 serves to control the grid current Ig flowing through the grid electrode 55 of the charger 50, and to control the development voltages Vd1 to Vd4 applied to the development rollers 45Y, 45M and 45C. The control unit 110 includes five PWM ports P0 to P4, and nine AD ports A0 to A8.

The control of the grid current Ig is performed by outputting the PWM signal S0 from the PWM port P0 and thereby adjusting the output voltage Vo of the charge voltage applying circuit 200. The control of the development voltages Vd1 to Vd4 is performed by outputting the PWM signals from the PWM ports P1 to P4 to the development voltage applying circuits 270B, 270Y, 270M and 270C, respectively.

The control unit 110 may be configured by accommodating a CPU therein or by an ASIC (Application Specific Integrated Circuit). The control unit 110 includes a built-in non-volatile storage unit (not shown), and various types of data (e.g., the following data (a) to (d)) for executing a grid current control process which is explained next are stored in the non-volatile storage unit.

(a) data of a reference value of the grid current Ig (250 μA)

(b) data of an upper limit of the grid current Ig (300 μA)

(c) data of a lower limit of the grid current Ig (200 μA)

(d) data of an upper limit of the output voltage Vo of the charge voltage applying circuit 200

It is known that the grid current Ig is approximately proportional to the discharge current flowing from the charger 50 to the photosensitive drum 41. Therefore, the grid current Ig serves as an indicator representing the level of the discharge current flowing through the photosensitive dram 51. That is, when the grid current Ig is the reference value of 250 μA, the discharge current flowing through the photosensitive drum 41 is a reference level and therefore the charge amount of the photosensitive drum 41 is a proper level.

Furthermore, when the grid current Ig is within the range from the lower limit value of 200 μA to the upper limit value of 300 μA, the magnitude of the discharge current flowing though the photosensitive drum 41 approximately falls within the permissible range. The upper limit value of 300 μA of the grid current Ig is an example of a first threshold, and the lower limit value of 200 μA of the grid current Ig is an example of a second threshold.

Figure 5:
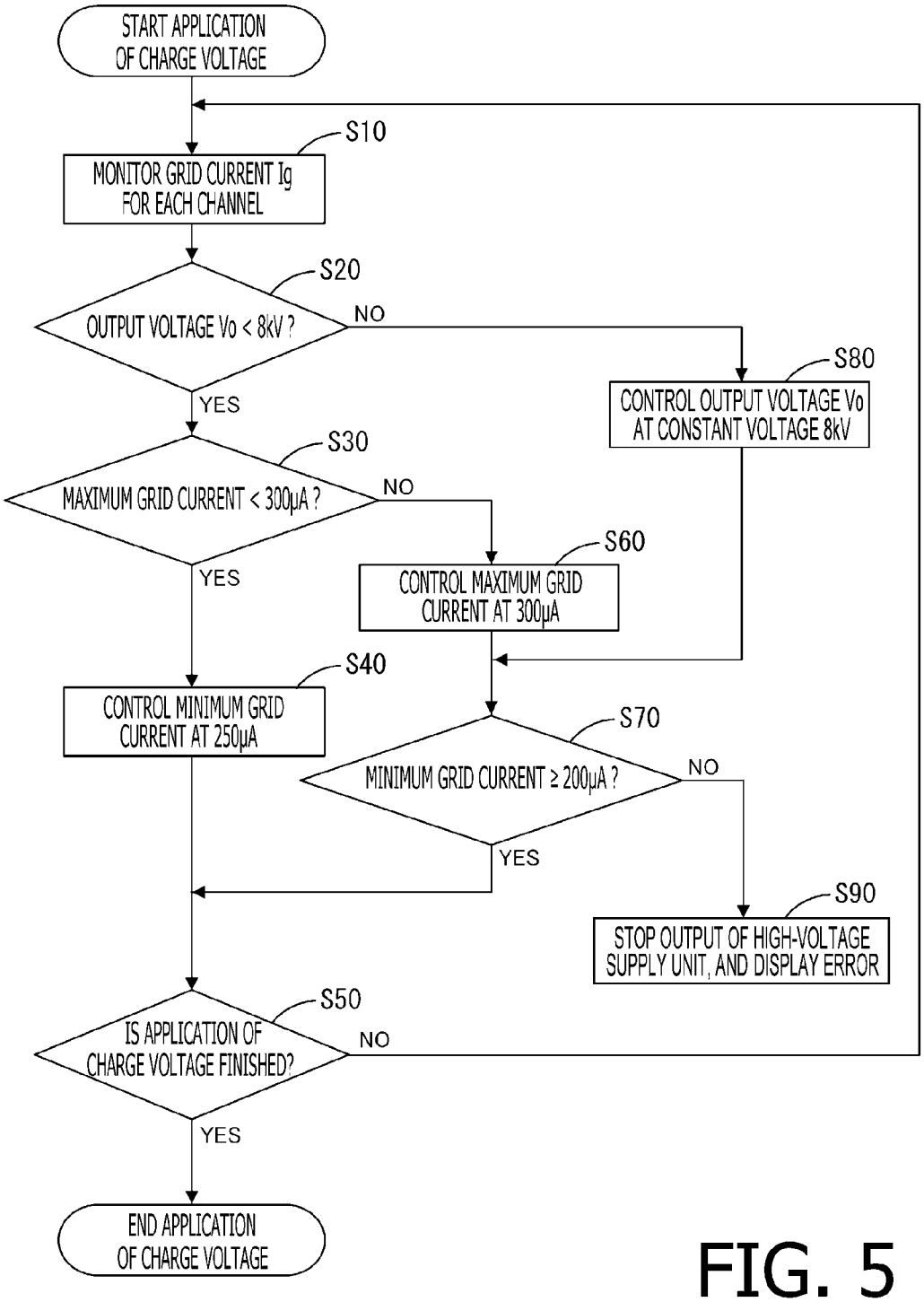
FIG. 5 is a flowchart illustrating a grid current control process according to the first embodiment.

Hereafter, the grid current control process executed by the control unit 110 is explained, with reference to FIG. 5. In the following explanations, channels CH mean the chargers 50B, 50Y, 50M and 50C. In this example, the chargers 50B<50Y, 50M and 50C are respectively represented as CH1, CH2, CH3 and CH4.

Figure 6:
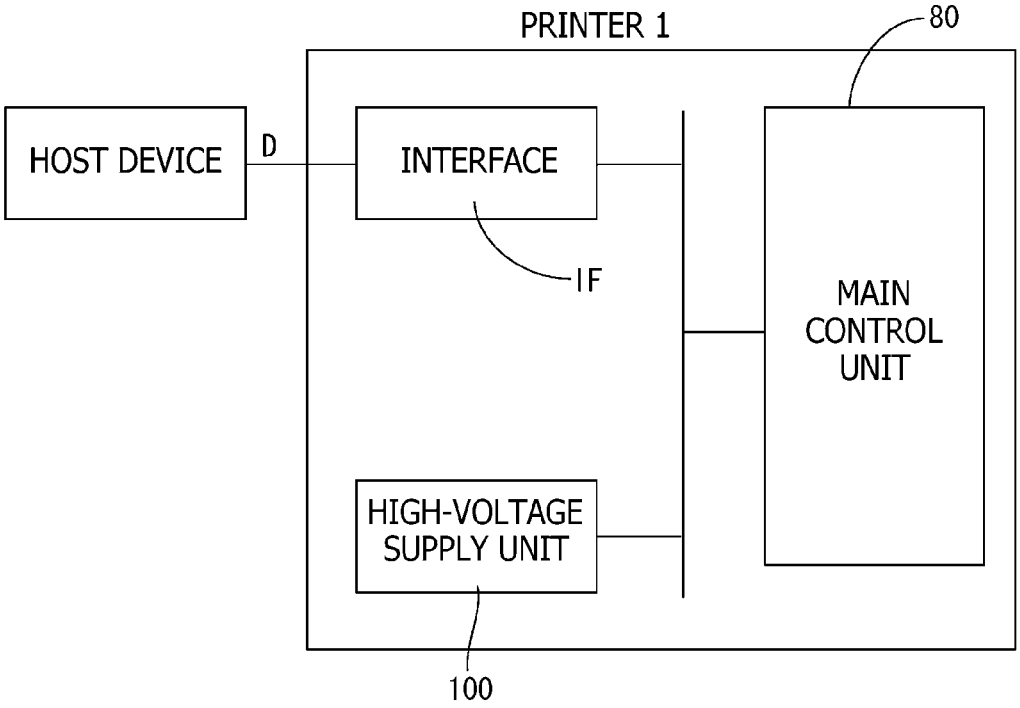
FIG. 6 illustrates an electric configuration of the printer.

As shown in FIG. 6, when print data D is outputted from a host device, the print data D is received by the printer 1 through an interface IF. Then, a print process start command is inputted from a main control unit 80 which totally controls the printer 1 to the control unit 110 of the high-voltage supply unit 100.

As a result, the control unit 110 starts the grid current control process shown in FIG. 5, and applies the charge voltages to the wires 53 of the chargers 50B, 50Y, 50M and 50C via the charge voltage applying circuit 200. The initial target of the charge voltage is, for example, 6 kV. Following the application of the charge voltage, the control unit 110 calculates and monitors the grid currents Ig of the respective channels CH from the input voltages of the AD ports A1 to A4 (S10).

Then, based on the input value (the voltage value detected by the voltage detection circuit 240) of the AD port A0, the control unit 110 detects the output voltage Vo of the charge voltage applying circuit 200, and judges the level of the output voltage Vo (S20). Specifically, the control unit 110 judges whether the output voltage Vo is smaller than the upper limit value of 8 kV. When the output voltage Vo is smaller than the upper limit value of 8 kV, it is judged to be "YES" and then the process proceeds to S30. When the output voltage Vo is larger than or equal to 8 kV, it is judged to be "NO" and then the process proceeds to S80.

When the output voltage Vo is judged to be smaller than 8 kV and the process proceeds to S30, the control unit 110 makes a comparison between the grid currents Ig of the respective channels CH monitored in S10, and obtains the maximum grid current Ig. Then, the control unit 110 judges the level of the maximum grid current Ig (S30). Specifically, the control unit 100 judges whether the maximum grid current Ig is smaller than the upper limit value of 300 μA. When the maximum grid current Ig is smaller than the upper limit value of 300 μA, it is judged to be "YES", and the process proceeds to S40. When the maximum grid current Ig is larger than or equal to the upper limit value of 300 μA, it is judged to be "NO", and the process proceeds to S60. In the following, explanations are made assuming that the judgment result is "YES".

When the maximum grid current Ig is judged to be smaller than the upper limit value of 300 μA and the process proceeds to S40, the control unit 110 adjusts the output voltage Vo of the charge voltage applying circuit 200 so that the minimum grid current Ig of the grid currents Ig of the respective channels becomes the constant current of 250 μA.

Figure 8:
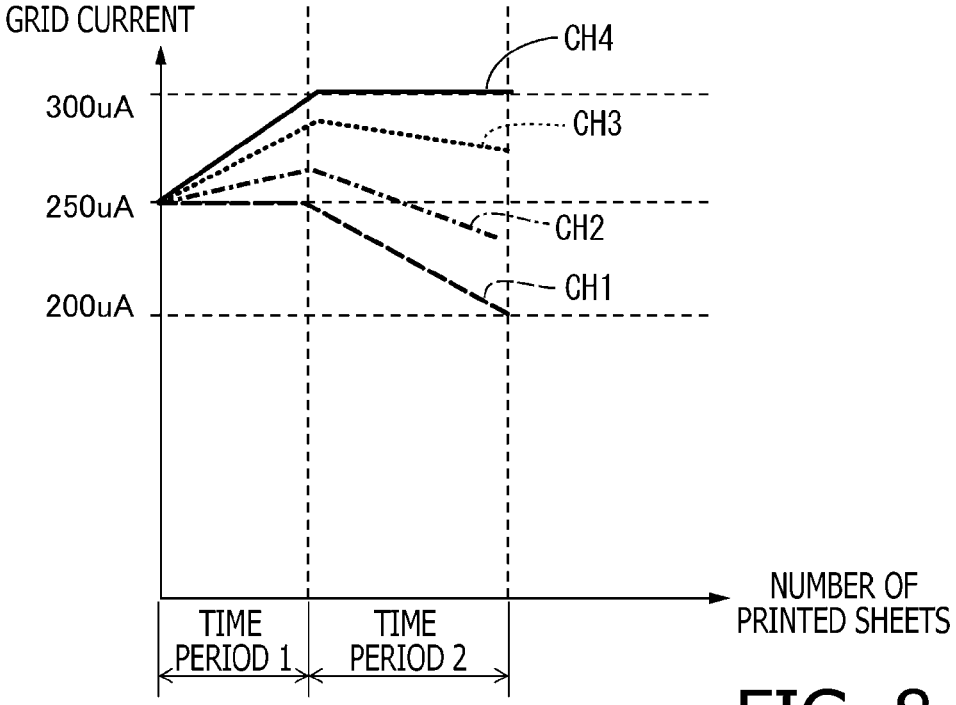
FIG. 8 is a graph illustrating a relationship between the number of printed sheets and a grid current of each channel.

Since, in the example of FIG. 8, the grid current Ig of the channel CH1 is the minimum, the control unit 110 monitors the input voltage of the AD port A1 corresponding to the channel CH1 to adjust the output voltage Vo of the charge voltage applying circuit 200, and executes the constant current control to keep the grid current Ig of the channel CH1 at 250 μA.

Then, the process proceeds to S50 where the control unit 110 judges whether the application of the charge voltage is finished. When the application of the charge voltage is not finished, the judgment result of S50 becomes "NO", and the process proceeds to S10 to execute the same steps from S10.

Therefore, as long as the judgment result of S20 and S30 does not become "NO" after start of application of the charge voltage, i.e., as long as the following two conditions are satisfied, the steps of S10 to S50 are repeated and therefore the state where the grid current Ig of the channel CH1 is controlled to be the constant current of 250 μA continues. As described above, in this embodiment, after start of application of the charge voltage, the minimum grid, current Ig is controlled to be the reference value. Therefore, it becomes possible to maintain the discharge amount of each charger 50 and the charge amount of each photosensitive drum 41 to be larger than or equal to the proper level. As a result, it becomes possible to suppress deterioration of the image quality due to shortage of the charge amount.

First condition: the output voltage Vo of the charge voltage applying circuit 200 is smaller than or equal to 8 kV Second condition: the maximum grid current Ig is smaller than or equal to the upper limit of 300 μA.

When the application of the charge voltage is completed following end of the printing, it is judged to be "YES" in S50. When the judgment result of S50 is "YES", the control unit 110 stops output of the charge voltage applying circuit 200. Thus, the sequence of process is finished.

Incidentally, since, due to corona discharge caused by application of the charge voltage, dust or silica adheres to the wire 53 of each charger 50, the resistance value of the wire 53 of each charger 50 increases in accordance with increase of the number of printed sheets.

Figure 7:
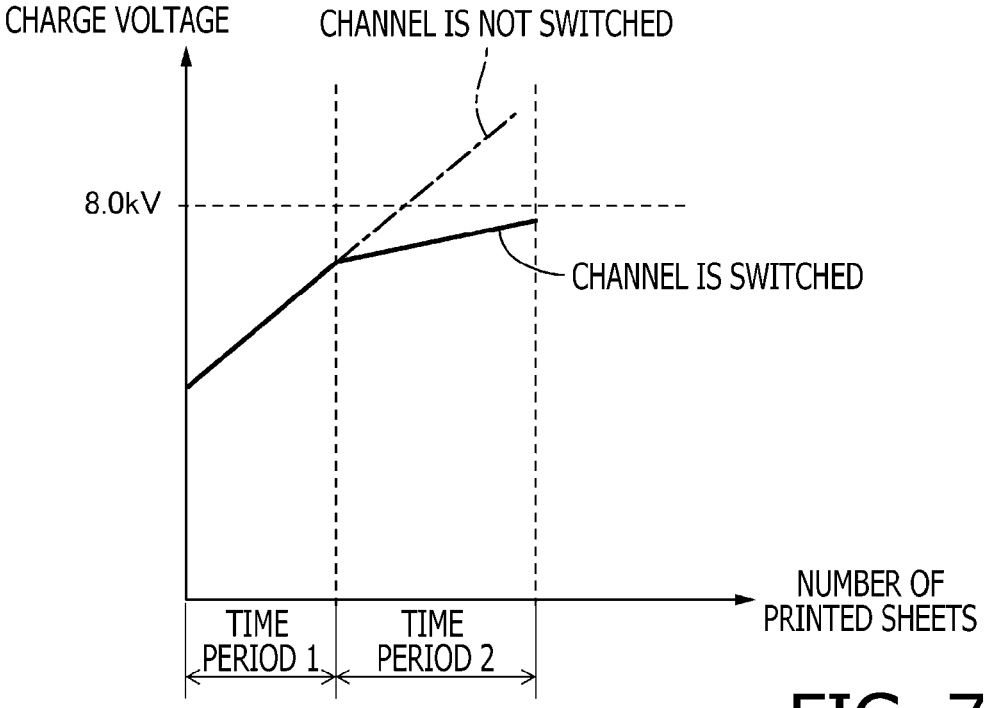
FIG. 7 is a graph illustrating a relationship between the number of printed sheets and a charge voltage.

Therefore, when the minimum grid current Ig is controlled to be kept at the constant current of 250 μA, the output voltage Vo of the charge voltage applying circuit 200 shows a tendency to increase in accordance with increase of the number of printed sheets (see FIG. 7). Furthermore, excepting the channel controlled to be the constant current of 250 μA (the channel CH1 in the example of FIG. 8), each grid current Ig shows a tendency to increase (see FIG. 8). It should be noted that the reason why the degrees of increase of the grid currents Ig are different from each other between the channels is that the amounts of silica or dust adhered to the wires 53 are different between the channels.

In the grid current control process according to the embodiment, the control unit 110 judges whether the maximum grid current Ig is smaller than 300 μA in S30 while monitoring the grid current Ig of each channel in S10, and when the maximum grid current Ig reaches the upper limit of 300 μA during application of the charge voltage, the judgment result of S30 becomes "NO".

In this case, the grid current control process moves to S60 from the state of repeating the processes of S10 to S50 (S30: NO). When the process moves to S60, the channel targeted for the constant-current control is changed from the channel of the minimum grid current Ig to the channel of the maximum grid current Ig, and the control unit 110 adjusts the output voltage Vo of the charge voltage applying circuit 200 so that the maximum grid current Ig is kept at the constant current of 300 μA.

In the example of FIG. 8, the grid current Ig of the channel CH4 is the maximum. Therefore, the channel targeted for the constant current control is changed from the channel CH1 to the channel CH4, and the control unit 110 adjusts the output voltage Vo of the charge voltage applying circuit 200 while monitoring the input voltage of the AD port A4 corresponding to the channel CH4 so that the grid current Ig of the channel CH4 is controlled to be the constant current of 300 μA.

After switching of the channels, the state of performing the constant-current control at 300 μA for the channel 4 continues excepting the case where the judgment result of S20 becomes "NO" and the judgment result of S70 becomes "NO" (the time period 2 in FIG. 8).

Since it is possible to suppress the grid current Ig to be smaller than or equal to the upper limit value for ail of the four channels, it becomes possible to prevent a large amount of discharge current from flowing from the wire 53 of each charger 50 to the photosensitive drum 41, i.e., to prevent occurrence of abnormal discharge. Consequently, it becomes possible to prevent deterioration of the photosensitive drum 41.

Figure 9:
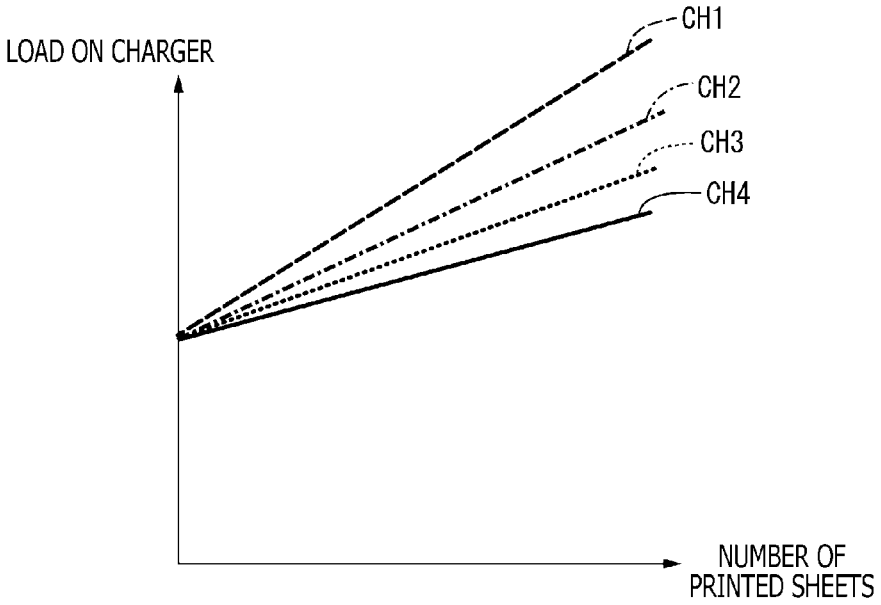
FIG. 9 is a graph illustrating a relationship between the number of printed sheets and a load on the charger.

Furthermore, as shown in FIG. 9, the magnitude of the load on each charger 50 due to increase of the number of printed sheets is proportional to the resistance value of the wire 53. In this embodiment, the channel for which the constant-current control is performed is changed from the channel of the minimum grid current (i.e., the channel in which the resistance of the wire 53 is large and the load on the charger 50 is large) to the channel of the maximum grid current (i.e., the channel in which the resistance of the wire 53 is small and the load on the charger 50 is small).

Therefore, in comparison with the case where switching of the channels is not performed, it becomes possible to suppress the increase of the output voltage Vo of the charge voltage applying circuit 200 due to increase of the number of printed sheets, as shown in FIG. 7. Consequently, the charger 50 becomes hard to cause abnormal discharge, and it becomes possible to increase the time period which elapses until the output voltage Vo reaches the upper limit. As a result, it becomes possible to increase the number of printed sheets.

Next, in S70, the control unit 110 judges the level of the minimum grid current Ig. Specifically, the control unit 110 judges whether the minimum grid current Ig is larger than or equal to the lower limit of 200 μA. When the minimum grid current Ig gets smaller than the lower limit of 200 μA while the maximum grid current Ig is controlled to be the constant current of 300 μA, the judgment result of S70 becomes "NO" and therefore S90 is processed.

In S90, the control unit 110 executes a process for stopping output of the charge voltage applying circuit 200 and a process for displaying an error for the channel whose grid current Ig is smaller than 200 μA. In the example of FIG. 8, the channel CH1 is a target for displaying of the error, and, for example, a message for requesting a user to clean the wire 53 of the charger 50B of the channel CH1 is displayed on a display unit (not shown).

By thus displaying such an error, it becomes possible to prevent the printing from being performed in the state where the grid current Ig is smaller than the lower limit. As a result, it becomes possible to prevent occurrence of deterioration of the image quality.

As described above, since the resistance value of the wire 53 increases in accordance with increase of the number of printed sheets, the output voltage Vo of the charge voltage applying circuit 200, i.e., the charge voltage of each charger 50, increases both in the time period 1 and the time period 2 in FIG. 8. In this embodiment, the level of the output voltage Vo of the charge voltage applying circuit 200 is judged in S20. When the output voltage Vo exceeds the upper limit of 8 kV, the judgment result of S20 becomes "NO", and the process proceeds to S80.

In S80, the control unit 110 controls the output voltage Vo of charge voltage applying circuit 200 to be the constant voltage of 8 kV while monitoring the input voltage of the AD port A0. Therefore, it becomes possible to suppress the charge voltage of the charge voltage applying circuit 200 to be smaller than or equal to the lower limit of 8 kV. As a result, it becomes possible to prevent occurrence of abnormal discharge of the charger 50.

Through steps S30 and S60 executed by the control unit 110 in FIG. 5, the function of a grid current control unit, i.e., "to execute a constant-current control for a maximum grid current which is a maximum of grid currents flowing through the grid electrodes so that the maximum grid current is kept at the first threshold (300 μA in the above described example) larger than or equal to the reference value by adjusting an output of the charge voltage applying circuit", is realized.

Furthermore, through steps S30 and S40 executed by the control unit 110 in FIG. 5, the function of the grid current control unit, i.e., "when starting the control, the grid current control unit executes a constant-current control for a minimum grid current which is a minimum of the grid currents flowing through the grid electrodes so that the minimum grid current is kept at the reference value (250 μA in the above described example)", is realized.

Furthermore, through steps S70 and S90 executed by the control unit 110 in FIG. 5, the function of a first indication unit, i.e., "for a scorotron charger whose grid current gets smaller than or equal to the second threshold (200 μA in the above described example) smaller than the reference value during the constant-current control for the maximum grid current, the first indication unit indicates an error", is realized.

Second Embodiment

Figure 10:
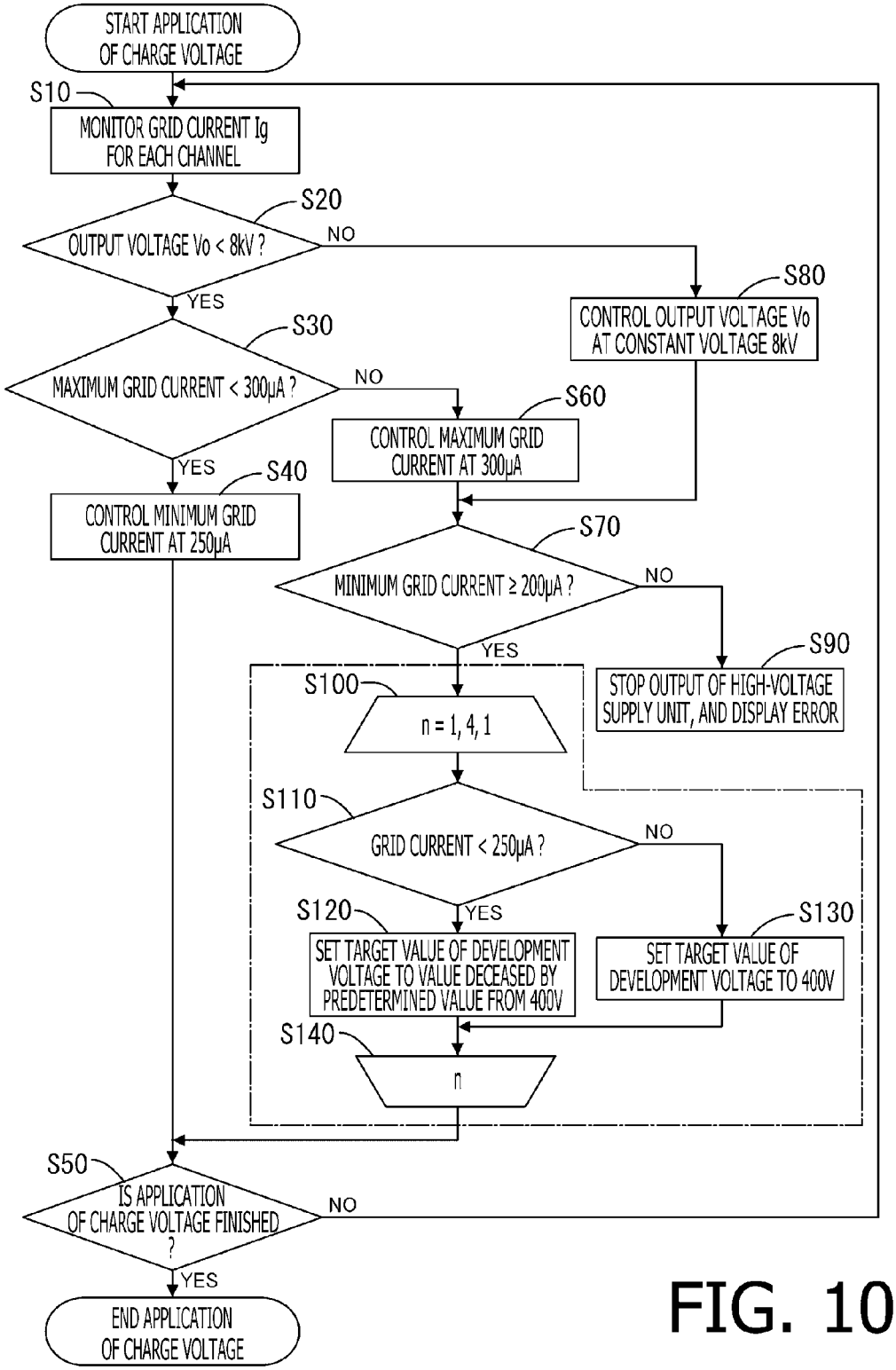
FIG. 10 is a flowchart illustrating a grid current control process according to a second embodiment.

Hereafter, a second embodiment is described with reference to FIGS. 10 to 12. As in the case of the first embodiment, the second embodiment is configured such that the minimum grid current Ig is controlled to be the constant current of 250 μA after start of application of the charge voltage, and after the maximum grid current Ig reaches the upper limit in accordance with increase of the number of printed sheets, the maximum grid current Ig is controlled to be kept at the upper limit value of 300 μA. In addition, in the second embodiment, the development voltage Vd of the channel whose grid current Ig shows a tendency to decrease is controlled to decrease while the maximum grid current Ig is controlled to be kept at the constant current of 300 μA. In FIG. 10, a process from S100 to S140 surrounded by a chain line is added to the grid current control flow of the first embodiment (the flow shown in FIG. 5).

In the process from S100 to S140, S110 to S130 are executed for each of the channels. That is, S110 to S130 are configured as a loop process in which S110 to S130 are executed four times (n=1 to 4) equal to the number of channels. The symbol "n" in each of S100 and S140 means the channel of the charger 50. "n=1,4,1" in S100 means the initial value is "1", the final value is "4" and "n" is incremented by one.

In S110, for the selected channel n, the control unit 110 judges the magnitude of the grid current Ig. Specifically, the control unit 110 judges whether the grid current Ig is smaller than the reference value of 250 μA.

When the grid current Ig is smaller than 250 μA, the judgment result of S110 becomes "YES", and the process proceeds to S120. In S120, the target value of the development voltage Vd is decreased from the reference value of 400V. Specifically, the target value of the development voltage Vd is decreased following decrease of the grid current Ig in accordance with the equation below.

$$Vd=400-(250-Ig)\times\alpha \quad (1)$$

where Ig represents the grid current (μA), and

α is an arbitrary constant.

On the other hand, when the grid current Ig is larger than or equal to 250 μA, the judgment result of S110 becomes "NO", and the process proceeds to S130. In S130, for the channel, a process in which the target value of the development voltage Vd is set to the reference value of 400V is executed.

Figure 11:
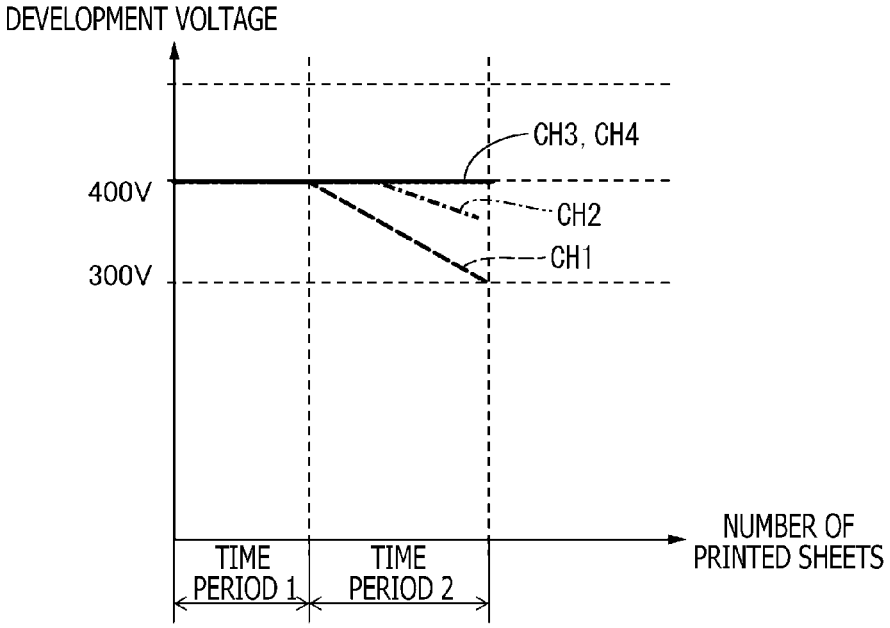
FIG. 11 is a graph illustrating a relationship between the number of printed sheets and a target value of a development voltage.

By executing these processes, for example, for the two channels CH1 and CH2 whose grid currents are smaller than the 250 μA, the target value of the development voltage Vd is lowered following decrease of the grid current Ig during the time period 2 in FIG. 8, as shown in FIG. 11.

As described above, in the second embodiment, the target value of the development voltage is lowered for the channel whose grid current is smaller than 250 μA. Therefore, it becomes possible to keep the potential difference between the charge voltage of the photosensitive drum and the development voltage of a developing unit. Therefore, it becomes possible to securely cause the toner (developer) to adhere to the exposed part of the photosensitive drum 41. As a result, it becomes possible to prevent occurrence of, for example, a so-called print fogging. That is, deterioration of the image quality can be prevented.

Figure 12:
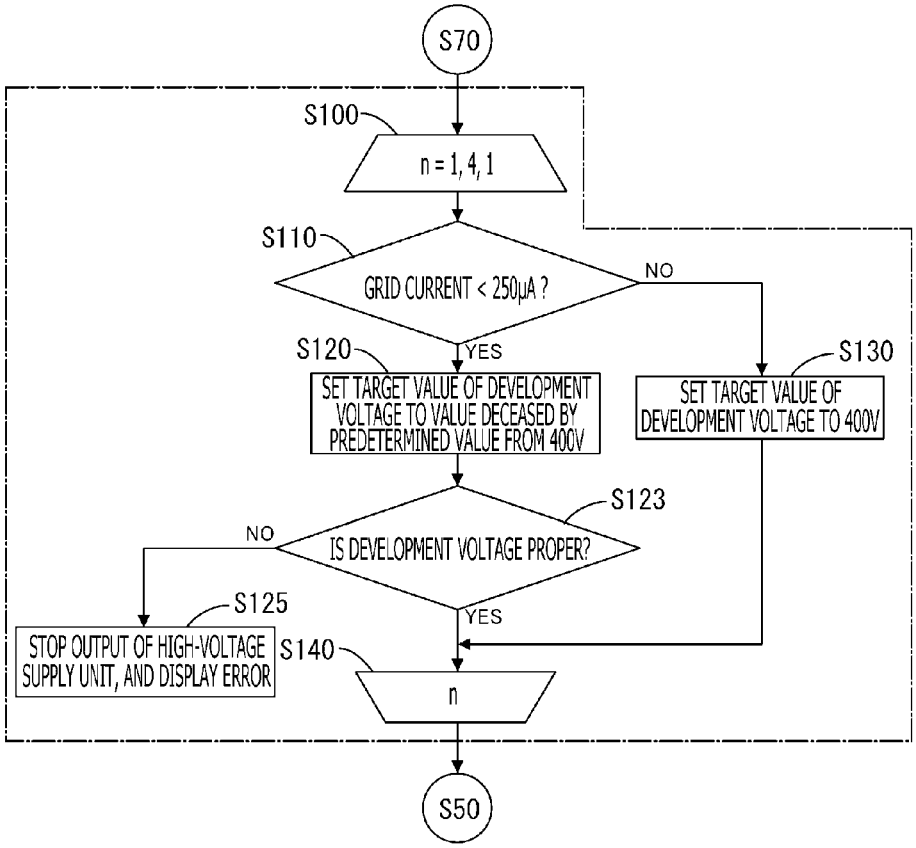
FIG. 12 is a flowchart of another example of the grid current control process.

As shown in FIG. 12, it is preferable that steps of S123 and S125 are added to the grid current control process of FIG. 10, and when the target value of the development voltage Vd gets smaller than the lower limit value (e.g., 300V) (when judgment result of S123 is NO), an error is displayed on a display unit (not shown). In this case, the development voltage Vd does not become smaller than the lower limit value. Therefore, the charge amount of the toner (developer) does not become insufficient. As a result, deterioration of the image quality can be prevented more properly.

Through steps S110 and S120 executed by the control unit 110 in FIG. 10, the function of a development voltage control unit, i.e., "for a developing unit which supplies the developer to the photosensitive body facing the scorotron charger whose grid current flowing through the grid electrode gets smaller than the reference value (250 μA in the above described example) during the constant-current control for the maximum grid current, the development voltage control unit lowers the target value of the development voltage", is realized.

Through steps S123 and S125 executed by the control unit 110 in FIG. 12, the function of a second indication unit, i.e., "for the scorotron charger which charges the photosensitive body to which the developer is supplied from the developing unit whose development voltage has become smaller than or equal to the lower limit value, the second indication unit indicates an error", is realized.

Other Embodiments

The present invention is not limited to the embodiments described above with reference to the drawings, but, for example, the following embodiments are also include in the technical scope of the invention.

(1) In the first embodiment, the example in which the upper limit value of the grid current Ig is assigned to the "first threshold" and the lower limit value of the grid current Ig is assigned to the "second threshold". However, it is sufficient that the "first threshold" is a value which is larger than or equal to the reference value and corresponds to the upper limit value. For example, the "first threshold" may be a value which has tolerance with respect to the upper limit value, i.e., a value slightly smaller than the upper limit value. It is sufficient that the "second threshold" is a value which is smaller than or equal to the reference value and corresponds to the lower limit value. For example, the "second threshold" may be a value which has tolerance with respect to the lower limit value, i.e., a value slightly larger than the lower limit value.

(2) In the first embodiment, in a time period elapsed, from start of application of the charge voltage, until the maximum grid current Ig reaches 300 μA (i.e., the time period 1 in FIG. 8), the minimum grid current is controlled to be the constant current of 250 μA. As another example of the control scheme during the time period elapsed, from start of application of the charge voltage, until the maximum grid current Ig reaches 300 μA, the constant current control may be performed for the grid currents Ig of the four channels so that the total current thereof is kept at 1 mA.

(3) In the above described second embodiment, the development voltage is lowered for the channel whose grid current Ig is smaller than 250 μA. However, the threshold value of the grid current for determining whether to lower the development voltage Vd is not limited to the reference value of 250 μA. For example, the reference value of the development voltage may be lowered for the channel whose grid current Ig is smaller than the lower limit of 200 μA.

Figure 13:
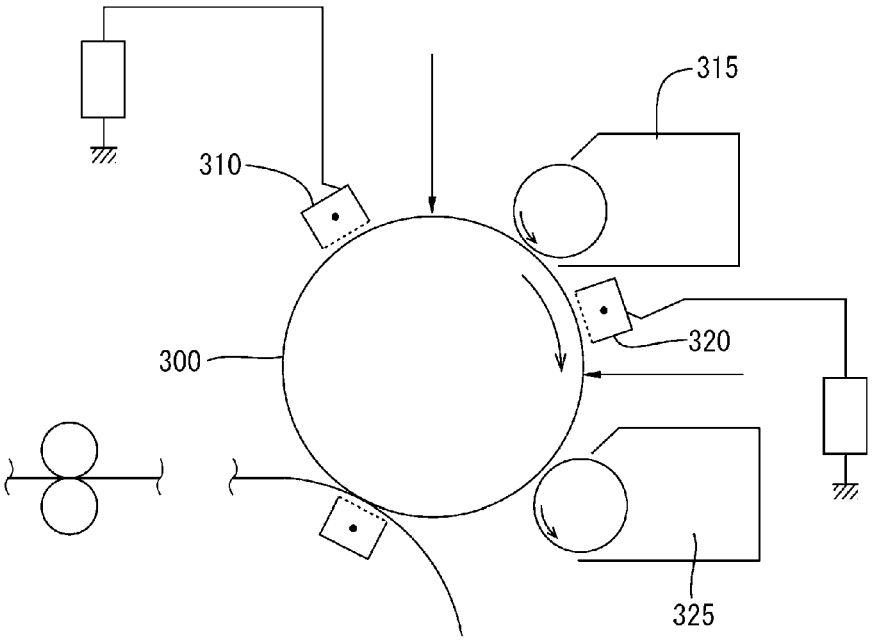
FIG. 13 illustrates a configuration of another example of the printer.

(4) In the above described first and second embodiments, a device in which each photosensitive drum 41 is assigned one charger 50 (i.e., a photosensitive dram 41 is provided for each color) is exemplified as an example of the printer 1. However, the present invention may be applied to a device in which a plurality of chargers 310 and 320 are provided for one photosensitive drum 300 as shown in FIG. 13 (i.e., in which toner images for the respective colors are overlaid on the photosensitive drum 300, and then the toner images are transferred to a sheet-like medium collectively). In FIG. 13, a reference number 315 represents a process unit (a developing unit) used in combination with the charger 310, and a reference number 325 represents a process unit (a developing unit) used in combination with the charger 320.

(5) In the first and second embodiments, the grid current detection units 260B, 260Y, 260M and 260C are provided respectively for the channels CH1 to CH4. However, a grid current detection unit may be shared by the channels. In this case, it is preferable to detect the grid current in a time sharing manner between the channels.

It is noted that various connections are set forth between elements in the foregoing description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

What is claimed is:

1. An image forming device, comprising:

at least one photosensitive body;

a plurality of scorotron chargers that charge the at least one photosensitive body:

a charge voltage applying circuit to which the plurality of scorotron chargers are commonly connected, the charge voltage applying circuit being configured to apply a voltage to the plurality of scorotron chargers;

wires respectively provided for the plurality of scorotron chargers;

grid electrodes respectively provided for the plurality of scorotron chargers;

a current detection unit configured to detect a grid current of each of the grid electrodes; and a grid current control unit configured to execute a constant-current control for a grid electrode which has a maximum grid current among the grid electrodes so that the maximum of a grid current among the grid currents is kept at a first threshold by adjusting an output of the charge voltage applying circuit, the first threshold being larger than a first reference value but lower than or equal to a second reference value.

2. The image forming device according to claim 1, wherein:

when starting the control, the grid current control unit executes a constant-current control for a grid electrode which has a minimum grid current among the grid electrodes so that the minimum grid current among the grid currents is kept at the reference value; and after the maximum grid current reaches the first threshold, the grid current control unit executes the constant-current control for the maximum grid current so that the maximum grid current is kept at the first threshold.

3. The image forming device according to claim 1, further comprising a first indication unit configured such that, for a scorotron charger whose grid current gets smaller than or equal to a second threshold smaller than the reference value during the constant-current control for the maximum grid current, the first indication unit indicates an error.

4. The image forming device according to claim 1, wherein the at least one photosensitive body comprises a plurality of photosensitive bodies, the image forming device further comprising:

developing units that supply developers of respective colors to the plurality of photosensitive bodies;

development voltage applying circuits that respectively apply development voltages to the developing units; and a development voltage control unit configured to control the development voltage applying circuits so that each of the development voltages of the respective developing units is set to a target value, wherein the development voltage control unit is configured such that, for a developing unit which supplies the developer to the photosensitive body facing the scorotron charger whose grid current flowing through the grid electrode gets smaller than the reference value during the constant-current control for the maximum grid current, the development voltage control unit lowers the target value of the development voltage.

5. The image forming device according to claim 4, further comprising a second indication unit configures such that, for the scorotron charger which charges the photosensitive body to which the developer is supplied from the developing unit whose development voltage has become smaller than or equal to a lower limit value, the second indication unit indicates an error.

6. A method of controlling a grid current, comprising:

charging at least one photosensitive body using a plurality of scorotron chargers;

applying a voltage to the plurality of scorotron chargers using a charge voltage applying circuit to which the plurality of scorotron chargers are commonly connected, wherein wires are respectively provided for the plurality of scorotron chargers and grid electrodes are respectively provided for the plurality of scorotron chargers;

detecting a grid current of each of the grid electrodes using a current detection unit; and executing, using a grid current control unit, a constant-current control for a grid electrode which has a maximum grid current among the grid electrodes so that the maximum of a grid current among the grid currents is kept at a first threshold by adjusting an output of the charge voltage applying circuit, the first threshold being larger than a first reference value but lower than or equal to a second reference value.

7. A non-transitory computer-readable medium storing a program for controlling a grid current that is executed by a computer of an image forming device, the program for controlling a grid current, when executed by the computer, causes the computer to:

charge at least one photosensitive body using a plurality of scorotron chargers;

apply a voltage to the plurality of scorotron chargers using a charge voltage applying circuit to which the plurality of scorotron chargers are commonly connected, wherein wires are respectively provided for the plurality of scorotron chargers and grid electrodes are respectively provided for the plurality of scorotron chargers;

detect a grid current of each of the grid electrodes using a current detection unit; and execute, using a grid current control unit, a constant-current control for a grid electrode which has a maximum grid current among the grid electrodes so that the maximum of a grid current among the grid currents is kept at a first threshold by adjusting an output of the charge voltage applying circuit, the first threshold being larger than a first reference value but lower than or equal to a second reference value.

* * * * *